US006285769B1

(12) United States Patent
Edelson et al.

(10) Patent No.: US 6,285,769 B1
(45) Date of Patent: Sep. 4, 2001

(54) FORCE BALANCE MICROPHONE

(75) Inventors: Jonathan Sidney Edelson, Multnomah County, OR (US); Nicholas Paul Ward, Sheffield (GB)

(73) Assignee: Borealis Technical Limited (GI)

( * ) Notice: Subject to any disclaimer, the term of this patent is extended or adjusted under 35 U.S.C. 154(b) by 0 days.

(21) Appl. No.: 08/843,678

(22) Filed: Apr. 10, 1997

(51) Int. Cl.[7] ..... H04R 3/00
(52) U.S. Cl. ..... 381/95; 381/111
(58) Field of Search ..... 381/95, 369, 176, 381/177, 111, 122

(56) References Cited

U.S. PATENT DOCUMENTS 4,273,968 * 6/1981 Suyama ..... 381/176
4,321,432 * 3/1982 Matsutani et al. ..... 381/111

OTHER PUBLICATIONS

Mada H., Muramatsu, Y. Direct optical digital detection of diaphragm deflection: maximum resolution. Appl. Optics (1986) 25(5):761–763.
Keating D.A. Force feedback microphone. Proc. Inst. Acoustics (1986) 8(6):67–73.
Karatzas L.S., Keating D.A. Usher M.J. Development of an optical microphone. In: Sensors; Technology, Systems and Applications (1991) pp 353–356. Adam Hilger, Bristol, UK.
Keating D.A., Karatzas L.S. Optical Microphony. Audio Engineering Society Preprint (1991) No. 3153.
Karatzas L.S., Keating D.A., Usher M.J. Reduction of Semiconductor Laser Noise, as applied to an optical microphone, using negative feedback. In: Sensors VI: Technology, Systems and Applications (1993) pp 233–238. IOPP, Bristol, UK.
Keating D.A. Optical Microphones. In: Microphone Engineering Handbook (1994) pp 154–157. Butterworths.
Karatzas L.S., Keating D.A., Usher M.J. A practical optical force–feedback microphone. Trans. Inst. Meas. Control. (1994) 16(2):75–85.

* cited by examiner

*Primary Examiner*—Forester W. Isen
*Assistant Examiner*—Brian Tyrone Pendleton

(57) ABSTRACT

The present invention is a microphone that applies the principle of negative feedback directly to the diaphragm, greatly reducing the non-linearity of the diaphragm. In a further embodiment, digital negative feedback is used, incorporating the diaphragm into the digitization loop of a sigma-delta converter, creating a direct sound pressure to digital electrical output converter. In one embodiment, positive feedback is used in an analog circuit, causing a negative feedback response on the diaphragm.

15 Claims, 4 Drawing Sheets

FORCE BALANCE MICROPHONE

CROSS REFERENCE TO RELATED APPLICATION

The present invention is related to the distributed digital conversion system, filed Apr. 12, 1996 application serial number 08/630,691.

BACKGROUND OF THE INVENTION

1. Field of Invention

The present invention relates to a conversion of sound to electrical signals in either analog or digital form. Sound as detected by microphones is caused by pressure changes in a medium.

2. Description of the Related Art

Sound is a propagating change or series of changes in the local pressure of a medium. The device which converts these pressure changes into electrical signals is the microphone. The microphone generally consists of some sort of transduction element, which physically moves in response to the pressure changes, and a mechanism which converts this physical motion into an electrical output signal. In most cases the transduction element is a diaphragm, but this is not always the case. In the current art, there are several commonly used detection mechanisms. In what follows, the description will focus on microphones designed for use in picking up audible sound in air, however the general principal of the present invention may be applied to all other microphone types.

There are disadvantages to this type of system. Firstly, the diaphragm (or other transduction element) is supported by a spring composed of the tension of the diaphragm itself, among other supports which depend upon microphone type. This spring will be imperfect, and will be acceptably linear only up to a maximum sound pressure level. Secondly, the diaphragm will have mass, which will limit the frequencies to which the microphone may respond, and which will introduce one or more resonant frequencies, which will result in non-linearity of frequency response at and near a given resonant frequency. Further, there is always an analog electronic system interfacing the diaphragm with the balance of system. This interface will itself be frequency sensitive and subject to non-linearity.

Realized microphone designs strive to minimize the effect of these various distortions in the intensity and frequency range of interest, through suitable selection of diaphragm type and electronic components. However, highly linear microphones are expensive and complex, and as the present invention will show, highly linear microphone systems can be constructed with more accurate output as well as lower cost. Presently, this is not available to the art.

Feedback is the principal of returning the output of an amplified system to the input, so as to reduce the gain of the system. While a reduction in gain is often considered a detriment, the benefits are that the linearity of the amplification system becomes dominated by the linearity of the feedback device.

While it is quite difficult to produce a linear amplifier, it is quite easy to produce an extremely high gain but non-linear amplifier. Coupled to highly linear resistive feedback, such an amplifier can be used to construct a highly linear, moderate gain system.

The analog to digital converter is a device which converts an input analog signal into a digital representation. This digital representation consists of a series of numbers which represent the amplitude of the analog input at specific moments in time. The series of numbers is a discretely sampled, quantized representation of the input.

Of particular interest are differential coding techniques, in which the output of an initial conversion step is subtracted from the input for the next conversion step, creating an output which corresponds to the difference between one sample and the next. With the addition of an integration filter, sigma-differential coding can be achieved, wherein the output of the converter is again a direct representation of the analog input, however the spectrum of the quantization noise is shifted to higher frequencies.

The limit of this design paradigm is the one bit sigma-differential pulse code modulator, or "Sigma-Delta" converter. With reference to FIG. 4, the quantized output of the one bit digital to analog converter is subtracted from the input analog signal, with the difference being integrated. The output of the integrator is fed to a comparator which acts as a single bit analog to digital converter. The output of this converter both supplies the digital output to the rest of the system, as well as providing the quantized output to be subtracted from the input.

The operation of the sigma-delta converter is as follows. The output of the integrator is evaluated by the comparator. The comparator outputs a "1" if the integrator output is above the reference value, and a "0" if the integrator output is below the reference value. The analog values of "1" and "0" are such that, through the differential stage feedback, a "1" will tend to cause the integrator output to fall below the reference value, and a "0" will tend to cause the integrator output to climb above the reference value. Over time, the duty cycle of "1" and "0" will represent the value of the input signal. Often higher order feedback loops are used which will tend to decrease the low frequency quantization noise at the expense of high frequency noise.

In common audio use is a sigma-delta converter with a sampling rate equal to sixty-four times the desired decimated output, using 5th order feedback in the sigma-delta conversion stage. The one bit output of this converter is decimated using digital techniques, and produces a 16 bit output with performance of a 16 bit linear converter.

Sigma-Differential conversion techniques, and the sigma-delta converter may be considered examples of the digital use of negative feedback in the digital domain. The quantizer is a highly non-linear device, however through the use of feedback substantial linearity may be achieved.

The method of the present invention makes new use of the concept of sigma-differential conversion techniques.

BRIEF SUMMARY OF THE INVENTION

The present invention is a microphone that applies the principle of negative feedback directly to the diaphragm, greatly reducing the non-linearity of the diaphragm. In a further embodiment, digital negative feedback is used, incorporating the diaphragm into the digitization loop of a sigma-delta converter, creating a direct sound pressure to digital electrical output converter. In a particularly simple embodiment, positive feedback is used in an analog circuit, causing a negative feedback response on the diaphragm without modification to the microphone itself.

Accordingly, besides the objects and advantages of the force balance microphone described in the present specification, several objects and advantages of the present invention are as follows.

It is an object of the present invention to provide a microphone which compensates for the non-linearities inherent in physical diaphragms and microphone transducers.

It is an advantage of the present invention that difficulties associated with coil mass, resonance, and coil velocity in moving coil microphones may be greatly reduced.

It is an advantage of the present invention that non-linearities associated with the diaphragm, diaphragm mass, and diaphragm suspension in condenser microphones may be greatly reduced.

It is an advantage of the present invention that electrical non-linearity in the piezoelectric element and mechanical damping may be greatly reduced.

It is an object of the present invention that novel microphone transducers characterized by high gain combined with extreme non-linearity may be profitably used in functional microphone systems.

It is an advantage of the present invention that such microphone systems may significantly outperform conventional microphones of equivalent cost.

It is an advantage of the present invention that the microphone will be able to faithfully reproduce sounds with an intensity range far greater than that of conventional microphones without volume induced distortion.

It is an object of the present invention to provide a microphone that functions as a direct analog pressure to digital output sigma- delta conversion device, resulting in a higher quality pressure wave measurement, and superior characteristics to those of conventional systems.

It is an advantage of the present invention that the microphone will be highly linear over its whole range.

It is an object of the present invention to provide a microphone that can use inexpensive elements to greatly enhance the output signal.

It is an advantage of the present invention that such a microphone would be inexpensive, and greatly enhance the quality of the sound output for a nominal cost.

It is an advantages of the present invention that such a microphone would be easily mass-producible.

Other objects and further advantages of the present invention will become apparent to those skilled in the art after a careful consideration of the following specification and accompanying drawings wherein: The force balance microphone comprises a transduction element, as found in a conventional microphone, combined with a mechanism which converts motion of the transduction element into an electrical output. Where the force balance microphone differs from the conventional microphone is that feedback means is added to prevent the motion of the transduction element. This feedback means is selected so as to be highly linear, thereby linearizing the operation of the microphone.

The force balance microphone thus comprises the following components: 1) the transduction element, 2) the motion detection system, 3) and the feedback system. All of these elements may be realized by a variety of means, many of these elements being used in one form or the other in the current art.

1) The transduction element: The most common transduction elements in the art are the diaphragm and the ribbon. Such elements may be beneficially used in the method of the present invention. Less common transduction elements which are integral with the motion detection system may also be used, for example piezoelectric films, metal-insulator-metal films, or variable refractive index materials.

2) The motion detection system: Again these are common in the art. Any of the aforementioned microphone devices use motion detection of one sort or another, e.g.: the condenser microphone detects capacitance changes between the diaphragm and the backplate. Motion detection systems not commonly used in the art may also be used, including tunneling current proximity detection, optical tunneling techniques, and optical interference techniques. Tunneling current detection warrants specific description because of its great simplicity and utility.

The quantum mechanical description of a particle uses wave equations to describe the position of the particle. This wave description of the location has a finite extent even for point particles such as the electron. An electron in one conductor has a certain finite probability of moving to another conductor, even if the two conductors are separated by a high potential barrier. The probability of an electron moving to the other conductor is greatly dependent upon the spacing between the two conductors. Tunneling current is extremely nonlinear and measurable only when the two conductors are separated by nanometer spacings. A tunneling probe may be separated from a surface by a spacing known to sub-angstrom accuracy.

3) The feedback system: The feedback system is not known in the art of microphones. Owing to the dual nature of many motion detection systems in common use, such systems may find new use in the method of the present invention. The feedback system may be any means useable to restore the transduction element to its equilibrium or rest state. The feedback system includes those circuit elements necessary to generate the appropriate signals for operating the feedback element, as well as the feedback element itself. As the feedback element is novel to the present invention, further general description is necessary.

Electrostatic feedback: The diaphragm of a condenser microphone may be moved by applying a potential difference between the diaphragm and the backplate. As potential difference is applied, the charge on the diaphragm and backplate increases, and the two are attracted together. This attraction is balanced by the diaphragm tension. Thus if a fixed potential difference is applied to the diaphragm and backplate, the diaphragm will move to an equilibrium potential. As the diaphragm moves under the influence of external pressure changes, it may be restored to the equilibrium position by altering the applied potential difference. Thus external pressure may be balanced through the use of extremely linear electrostatic forces.

Magnetic feedback: If a current is passed through the coil of a moving coil microphone, the coil will move. This is the principal of operation of the conventional dynamic speaker. By passing current through a coil attached to the transduction element, the transduction element may be restored to its equilibrium position. By keeping the transduction element, coil, and permanent magnet in the same relative position, the linearity of the microphone is greatly enhanced. Similarly, by passing a current through the ribbon of the ribbon microphone, the ribbon may be held in constant position.

Piezoelectric feedback: When a voltage is applied to a piezoelectric element, it moves. This may be used to restore a transduction element to equilibrium position. Feedback control electronics: All the above feedback mechanisms require some form of voltage or current input. Conventional analog electronics may be used to provide the feedback signals. Far more attractive, however, is to supply the feedback signal from the digital output of a differential-sigma analog to digital converter. In such a device, the mass of the diaphragm will act as the integrator, while the action of pressure variation and feedback mechanism upon the diaphragm will act as the adder element. Such a device would constitute a direct pressure to digital converter.

DETAILED DESCRIPTION OF THE INVENTION

To enable an individual skilled in the art to implement the above stated principals of the present invention, specific embodiments are herein provided. These should not be considered as limiting the scope of the invention, as the above description makes clear that numerous variations are possible. The below comprise specific best modes of operation.

Figure 1:
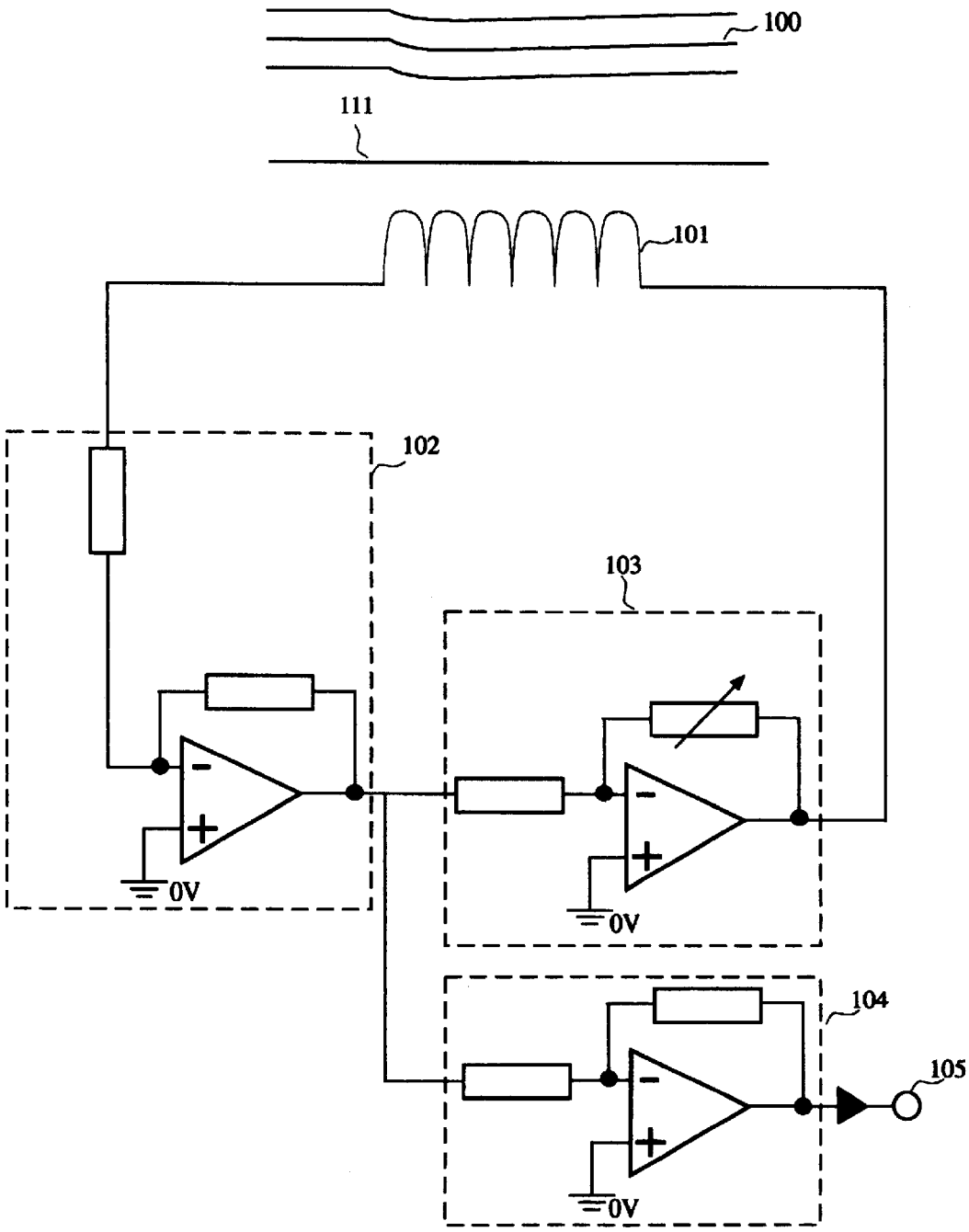
FIG. 1 is a schematic diagram showing a preferred embodiment of an analog force-balanced microphone.

FIG. 1 shows a schematic diagram of a circuit of a particularly inexpensive force balance microphone using a single coil. It represents one embodiment of the present invention. Clearly, other modifications, applications and embodiments will become apparent to those skilled in the art.

With reference to FIG. 1, sound 100 displaces a diaphragm 111 and microphone coil 101, generating electrical signals in microphone coil 101. One output of the microphone coil 101 is buffered by operational amplifier 102, configured as a unity gain inverting amplifier.

The output of operational amplifier 102 supplies high impedance variable gain inverting operational amplifier 103 and output operational amplifier 104. Operational amplifier 103 is configured as a variable gain inverting amplifier, with gain between −1 and −2.5. Output of operational amplifier 103 is connected to the second output of coil 101. Operational amplifier 104 is configured as a unity gain inverting amplifier.

Power supplies for the active components are not shown, but will be understood by anyone skilled in the art. Likewise, operational amplifier implementation details are excluded from this discussion.

In operation, current flow through coil 101, caused by motion of said coil through the magnetic field of the microphone, is detected, amplified, and fed back to the microphone. The combination of microphone coil impedance and circuit negative impedance presents a relatively low impedance circuit for currents generated by the motion of coil 101 with currents being much higher than normally encountered in voltage gain microphone circuits.

As per Lens' Law, a current produced in a conductor by changing the magnetic flux linked by the conductor will act to retard the change of flux linking. In the present embodiment, the currents generated by the microphone coil, and fed back to the coil by the amplifier circuit, act to retard the motion of the microphone coil. Thus acoustic forces are balanced by electromagnetic forces.

Because of the positive feedback nature of the present embodiment, if gain of operational amplifier 103 is too high, the circuit will lock up or oscillate. However at suitably tuned gain levels, it is noted that resonance peaks of the microphone system are substantially reduced, with noticeable flattening of the frequency response and an increase in frequency response range.

To summarize, in operation, current flow through microphone coil 101, caused by motion of microphone coil 101 through the magnetic field of the microphone is detected, amplified, and fed back into the microphone. This amplified current flow acts against motion of the coil 101 and diaphragm 111, thereby linearizing operation of the microphone.

In listening tests the above circuit had the following acoustic effects: it reduced the two resonant "humps" in the frequency response curve. This noticeably improved intelligibility and quality of speech. Secondly, there was a marked improvement in the phase response which also aided intelligibility.

FIG. 1 represents a preferred embodiment because its cost is extremely low, allowing it to be used in inexpensive and very common microphones, such as those in telephones, voicemail systems, and the like.

Figure 2:
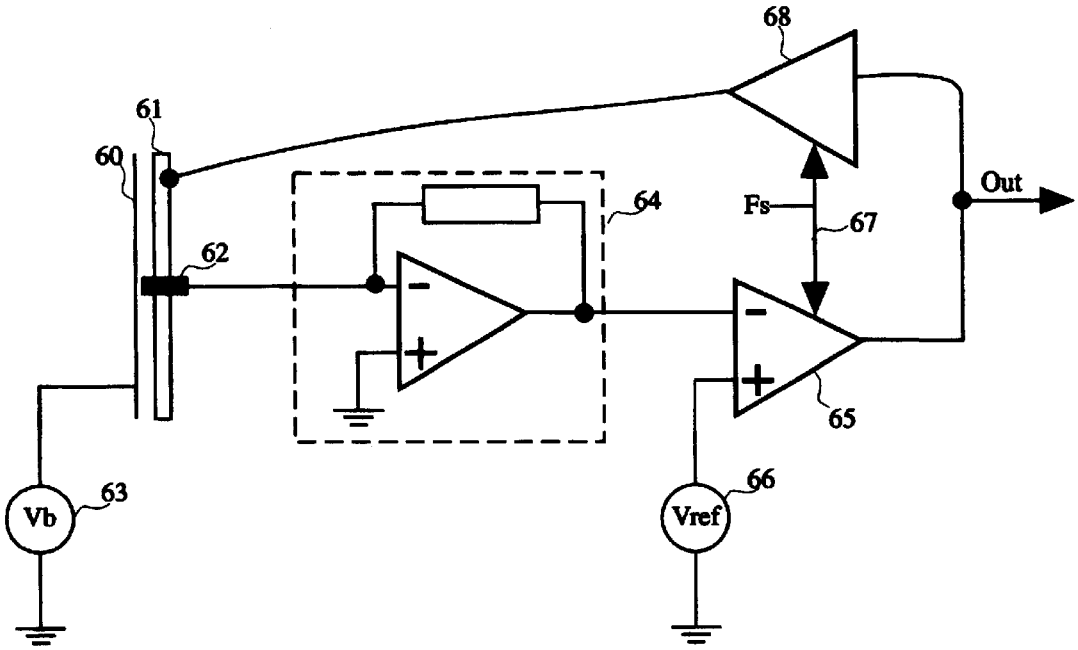
FIG. 2 is a schematic diagram showing a condenser microphone with tunneling detection and digital electrostatic feedback.

With reference to FIG. 2, a metalized diaphragm 60 is supported near to a backplate 61 in the conventional fashion for condenser microphones. Mounted in center of backplate 61, and electrically isolated therefrom, is a tunneling probe 62. Diaphragm 60 is electrically connected to a bias voltage source 63.

Tunneling probe 62 is electrically connected to a transconductance amplifier 64, the output of which is connected to a latching comparator 65. Latching comparator 65 is supplied with a reference voltage 66 and a sampling clock 67. Output of latching comparator 65 is fed to a one bit digital to analog converter (DAC) 68. The one bit DAC 68 is further supplied with sampling clock 67. Output of one bit DAC 68 is electrically connected to backplate 61.

Power supplies for the active components are not shown, but will be understood by anyone skilled in the art. Likewise, operational amplifier implementation details are excluded from this discussion.

In operation any tunneling current between diaphragm 60 and probe 62 will cause an output voltage to be produced by amplifier 64. This output voltage is compared to reference voltage 66 by comparator 65. Once per clock cycle, the result of the comparison is updated, and an output voltage corresponding to "1" or "0" is produced. This output voltage is available to the one bit DAC 68. Every clock cycle, one bit DAC 68 latches an output which corresponds to its input voltage of the preceding clock cycle. In this way, the output of comparator 65 is fed back with a delay of one clock cycle. Output of comparator 65 comprises a one bit digital data stream, and is the output of the microphone system.

Diaphragm 60 is biased by bias source 63 to a negative voltage relative to ground.

One bit DAC 68, in response to input from comparator 65 generates pulses of positive or negative charge which are carried to backplate 61. An input of "1" indicates that the diaphragm 60 is closer to the backplate 61 than equilibrium, and causes DAC 68 to produce a pulse of negative charge. This pulse of negative charge will reduce the attraction between backplate 61 and diaphragm 60. An input of "0" indicates that the diaphragm 60 is more distant from the backplate 61 than equilibrium, and causes DAC 68 to produce a pulse of positive charge. This pulse of positive charge will increase the attraction between backplate 61 and diaphragm 60.

The net result will be an output one bit datastream with variable duty cycle corresponding to the force necessary to maintain the diaphragm in a fixed location.

Figure 3:
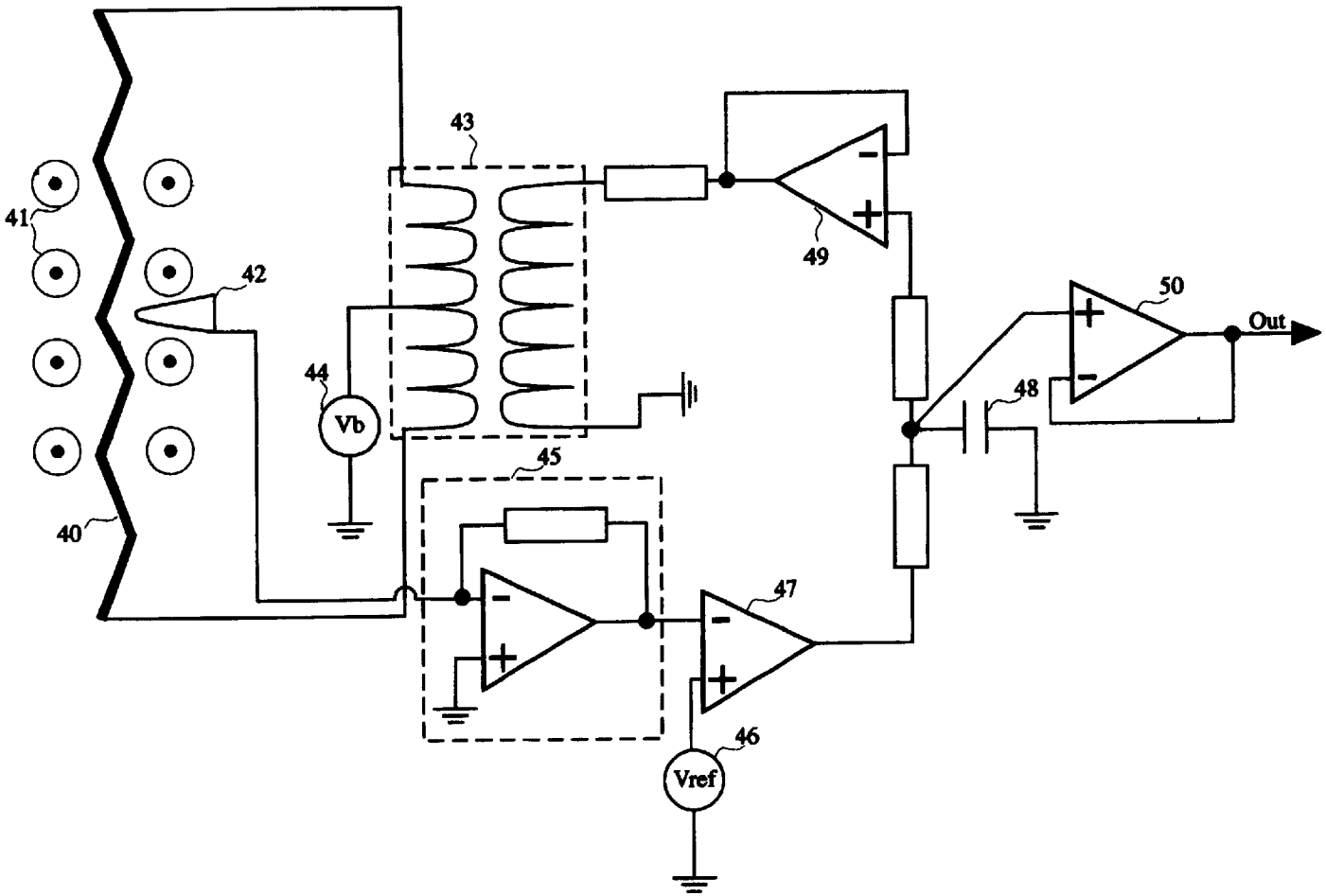
FIG. 3 is a schematic diagram showing a ribbon microphone with tunneling detection and magnetic feedback.
Figure 4:
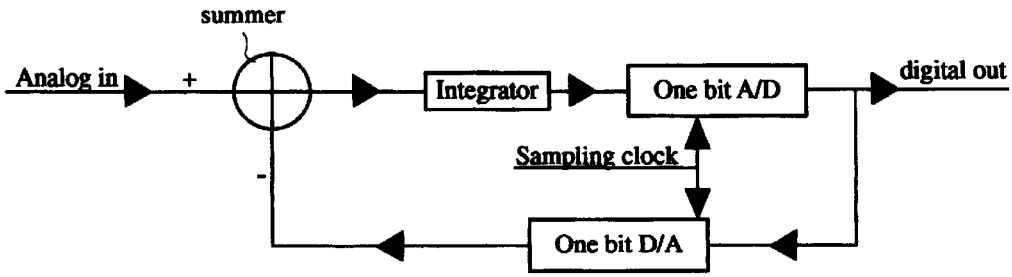
FIG. 4, discussed in prior art section, is a block diagram showing a first order Delta-Sigma A/D converter.

With reference to FIG. 3 a ribbon 40 is supported between poles of a magnet 41, schematically shown as the magnetic field lines produced by the magnet, such that the magnetic field of magnet 41 is generally perpendicular to the long direction of ribbon 40 and is further perpendicular to the direction of motion of ribbon 40 when ribbon 40 flexes. A probe 42 is oriented perpendicular to the plane of ribbon 40, and is further positioned proximally to the center of ribbon 40, separated by a small gap. The probe 42 is close enough to the ribbon that the ribbon could flex so as to contact the probe.

The ends of ribbon 40 are electrically connected to the center tapped secondary of an audio transformer 43. The center tap of the secondary of transformer 43 is connected to a bias voltage supply 44, floating the secondary and the ribbon 40 about -10 volts below ground. The probe 42 is held at a virtual ground by a transconductance amplifier 45, which converts any current between ribbon 40 and probe 42 into a voltage.

The output of amplifier 45 is compared with a reference voltage 46 by a comparator 47. Reference voltage 46 is connected to the positive acting pin of comparator 47. The output of comparator 47 charges an integrating capacitor 48. The voltage on the integrating capacitor 48 is buffered by a unity gain follower 49, the output of which is fed to the primary of the audio transformer 43. The voltage on the integrating capacitor 48 is additionally buffered by a follower 50, the output of which is the analog electrical output of the microphone system.

Power supplies for the active components are not shown, but will be understood by anyone skilled in the art. Likewise, operational amplifier implementation details are excluded from this discussion.

In operation, any tunneling current between ribbon 40 and probe 42 is amplified by amplifier 45 and compared with voltage 46. If the ribbon 40 is far from probe 42, then the tunneling current will be small or zero, and the comparator 47 will output a positive voltage. This positive voltage will charge capacitor 48 with a positive charge relative to ground. The following amplifier 49 will pass the voltage on capacitor 48 to the primary of transformer 43. Transformer 43 will impose this voltage on the ribbon 40, causing a current to flow in the ribbon 40.

Due to the interaction of the current flowing in the ribbon 40 and the magnetic field generated of magnet 41, ribbon 40 will experience a bending force. This force will act to push ribbon 40 toward probe 42, increasing the level of tunneling current.

When ribbon 40 is sufficiently close to probe 42, substantial tunneling current will flow, and the output of amplifier 45 will increase. When the output of amplifier 45 is equal to reference voltage 46, then the output of comparator 47 will be zero, and the voltage on capacitor 48 will become constant. The current through the ribbon will become constant, and the ribbon will be held stationary in equilibrium between ribbon tension and magnetic force.

In response to acoustic pressure moving the ribbon, tunneling current to probe 42 will change, thus changing the output voltage from amplifier 45, finally changing the results of comparison with reference voltage 46. The change of voltage on capacitor 48 will result in changing current in ribbon 40, restoring ribbon 40 to equilibrium position.

The voltage on capacitor 48 is a measure of the force needed to maintain ribbon 40 at its equilibrium position. This voltage is buffered by follower 50 to provide the output of the microphone system.

This invention is a method for using feedback to more accurately capture sound. While the above description contains many specificities, these should not be construed as limitations on the scope of the invention, but rather as an exemplification of some of the preferred embodiments thereof. Many other variations are possible. For example, in the embodiment which uses op-amps, a wide number of other elements could alternatively be used, such as discrete transistors, MOSFETS, FETs, valves, vacuum tubes, and unijunction transistors. In fact, it would be apparent to one skilled in the art that any form of inverting amplifier could conceivably be employed in this circuit. Additionally, with reference to FIG. 1, the output signal could be taken from a combination of the coil output signal and the feedback signal, or it could also be taken solely from the feedback signal.

Detection means are not limited to those described, but could include any technique which detects the motion of the transduction element. For example, a variable refractive index interferometric system could be used, differential variable transformer techniques, or strain gauge techniques could be used.

Feedback means are not limited to those described, but could include any linear technique for restoring the transduction element to equilibrium. Electrostatic and electromagnetic systems have been described, however thermal, thermal resistive, optical and other possible systems could be used.

Accordingly, the scope of the invention should be determined not by the embodiment illustrated, but by the appended claims and their legal equivalents.

We claim:

1. A microphone system for the detection of pressure variations in a medium, comprising:

transduction means for the conversion of said pressure variations into displacement of said transduction means;

detection means for the conversion of said displacement into variations of an electrical output;

feedback means for the cancellation of said displacement, whereby nonlinearities of said transduction means or said detection means are reduced or eliminated from the output of said microphone system;

wherein said transduction means is a metal ribbon, wherein said detection means is a tunneling current detector arranged proximally to said metal ribbon, said tunneling current detector consisting of a probe and a transimpedance amplifier, a suitable bias voltage being applied between said metal ribbon and said tunneling current detector, wherein said feedback means is analog electromagnetic feedback, said analog electromagnetic feedback consisting of a comparator taking as input the output of said tunneling current detector and a reference voltage, said comparator charging an integrating capacitor, said integrated comparison result controlling a variable current source supplying current to said metal ribbon, said metal ribbon mounted in a magnetic field transverse to the plane of said ribbon, whereby displacements in the position of said ribbon will be detected, causing the production of a current through said ribbon which will cause a restoring force to be developed in said ribbon.

2. A microphone system as in claim 1, wherein said pressure variations in a medium are acoustic pressure variations in air.

3. A microphone system for the detection of pressure variations in a medium, comprising:

transduction means for the conversion of said pressure variations into displacement of said transduction means;

detection means for the conversion of said displacement into variations of an electrical output;

feedback means for the cancellation of said displacement, whereby nonlinearities of said transduction means or said detection means are reduced or eliminated from the output of said microphone system;

wherein said transduction means is a conductive diaphragm, wherein said detection means is a tunneling current detector arranged proximally to the center of said conductive diaphragm, said tunneling current detector consisting of a probe and a transresistance amplifier, a suitable bias voltage being applied between said conductive diaphragm and said tunneling current detector, wherein said feedback means is digital electrostatic feedback, said digital electrostatic feedback consisting of a latching comparator taking as input the output of said tunneling current detector and a reference voltage, said comparator further receiving as input a sampling clock, said comparator producing a binary output which is fed to a one bit digital to analog converter, said output of said one bit digital to analog converter varying the potential on a backplate, said backplate being proximal to said conductive diaphragm, whereby displacements in the position of said conductive diaphragm will be detected, causing a change in potential of said backplate, resulting in a restoring force applied to said conductive diaphragm.

4. A microphone system as in claim 7, wherein said pressure variations in a medium are acoustic pressure variations in air.

5. A method for converting sound to an output signal, comprising:

allowing said sound to displace a transduction means;

detecting the movement of said transduction means, thereby creating an initial signal;

generating a feedback signal from said initial signal;

restoring said transduction means to an equilibrium position using said feedback signal;

forming said output signal; and altering said output signal using inverting amplification to decrease apparent transducer impedance and increase transducer current flow.

6. The method of claim 8, wherein said output signal is selected from the group consisting of said input signal, said feedback signal, a combination of said input signal and said feedback signal, whereby nonlinearities of said transduction means are reduced or eliminated from said output signal.

7. The method of claim 9, wherein said inverting amplification is selected from the group consisting of operational amplifiers, discrete transistors, MOSFETs, FETs, valves, and unijunction transistors.

8. The method of claim 5, wherein said feedback signal is selected from the group consisting of said input signal, said output signal, and a combination of said input signal and said output signal.

9. The method of claim 8, wherein said feedback signal is modified using inverted amplification.

10. The method of claim 9, wherein said inverting amplification is selected from the group consisting of operational amplifiers, discrete transistors, MOSFETs, FETs, valves and unijunction transistors.

11. The method of claim 5, wherein said transduction means is a diaphragm.

12. The method of claim 5, wherein movement is detected by a coil in a magnetic field.

13. The method of claim 5, wherein all signals are analog, whereby feedback is near-instantaneous.

14. The method of claim 13, wherein said feedback signal restores transduction means to said equilibrium position by means of negative impedance.

15. A microphone system for the detection of a pressure variation in a medium, comprising:

transduction means for converting said pressure variation into a displacement of a conductor in a magnetic field;

said conductor connected electrically, in series, to a negative impedance circuit, wherein the impedance of said conductor and said negative impedance circuit is minimized; and wherein the displacement of said conductor causes a high current to flow in said conductor which reacts with said magnetic field causing a magnetic reaction force acting against said displacement.

* * * * *